United States Patent [19]

Hollingsworth et al.

[11] Patent Number: 4,954,098

[45] Date of Patent: Sep. 4, 1990

[54] SEALED INSULATION DISPLACEMENT CONNECTOR

[75] Inventors: Elmont E. Hollingsworth; Gary W. Schlaeger, both of Austin, Tex.

[73] Assignee: Minnesota Mining and Manufacturing Company, St. Paul, Minn.

[21] Appl. No.: 430,863

[22] Filed: Nov. 1, 1989

[51] Int. Cl.[5] ..... H01R 4/24

[52] U.S. Cl. ..... 439/404; 439/406; 439/936; 439/350

[58] Field of Search ..... 439/271–283, 439/389–407, 409, 410, 417–419, 596, 411, 936, 350

[56] References Cited

U.S. PATENT DOCUMENTS

| | | | |
|---|---|---|---|
| D 191,399 | 9/1961 | Leach | D26/1 |
| 3,012,219 | 12/1961 | Levin et al. | 339/98 |
| 3,189,863 | 6/1965 | Leach | 339/99 |
| 3,202,957 | 8/1965 | Leach | 339/98 |
| 3,258,733 | 6/1966 | Elm | 339/98 |
| 3,388,370 | 6/1968 | Elm | 339/98 |
| 3,410,950 | 11/1968 | Freudenberg | 174/84 |
| 3,500,292 | 3/1970 | Enright et al. | 339/97 |
| 3,573,713 | 4/1971 | Enright et al. | 339/98 |
| 3,576,518 | 4/1971 | Bazille et al. | 339/98 |
| 3,605,072 | 9/1971 | Driscoll | 339/98 |
| 3,609,644 | 9/1971 | Seim | 339/98 |
| 3,656,088 | 4/1972 | Seim | 339/98 |
| 3,723,948 | 3/1973 | Wyatt et al. | 339/99 |
| 3,793,611 | 2/1974 | Johansson et al. | 339/98 |
| 3,793,612 | 2/1974 | Driscoll | 339/98 |
| 3,804,971 | 4/1974 | Bazille | 174/88 |
| 3,845,236 | 10/1974 | Anderson | 174/88 |
| 3,858,157 | 12/1974 | Bazille | 339/98 |
| 3,869,190 | 3/1975 | Bazille | 339/98 |
| 3,912,356 | 10/1975 | Johansson | 339/98 |
| 3,949,467 | 4/1976 | Mayala et al. | 29/628 |
| 4,124,265 | 11/1978 | Turk | 339/97 |
| 4,326,767 | 4/1982 | Silbernagel et al. | 339/98 |
| 4,435,034 | 3/1984 | Aujla et al. | 439/404 |
| 4,444,447 | 4/1984 | Markwardt | 339/98 |
| 4,444,448 | 4/1984 | Silbernagel et al. | 339/98 |
| 4,444,449 | 4/1984 | Aysta et al. | 339/99 |
| 4,496,206 | 1/1985 | Markwardt et al. | 339/98 |
| 4,552,429 | 11/1985 | van Alst | 439/404 |
| 4,734,048 | 3/1988 | Giebel et al. | 439/409 |
| 4,834,668 | 5/1989 | Markwardt | 439/392 |

FOREIGN PATENT DOCUMENTS

| | | | |
|---|---|---|---|
| 2585192 | 1/1987 | France | 439/411 |
| 2101420 | 3/1985 | United Kingdom . | |

*Primary Examiner*—David L. Pirlot

*Attorney, Agent, or Firm*—Donald M. Sell; Walter N. Kirn; Jack V. Musgrove

[57] ABSTRACT

An insulation displacement connector (IDC) having internal sealing material which is packed around the wires as the connection is made. The IDC has a plurality of channels for receiving the wires, and at least one metallic element providing electrical contact between the wires. A plurality of voids are in fluid communication with the channels, and the voids are filled with the sealing material, such as a mastic or silicone grease. When the IDC is moved from an open to a closed position, the metallic element makes contact between the wires, and a piston or post subsequently enters the voids, causing the sealant to flow into the channels about the wires and the contact interface.

12 Claims, 2 Drawing Sheets

SEALED INSULATION DISPLACEMENT CONNECTOR

BACKGROUND OF THE INVENTION

1. Field of the Invention

The present invention generally relates to electrical connectors, and more particularly to an insulation displacement connector used to connect electrical wiring, the connector having a conformable sealing material which flows around the wires as the connection is made.

2. Description of the Prior Art

Insulation displacement connectors (also known as solderless electrical connectors) are known in the art, and are used to interconnect conductors which have an outer insulating layer. These devices typically include a central body or housing having one or more channels therein for receiving the conductors, and a U-shaped metallic contact element which provides the electrical connection between the conductors. As an insulated conductor is placed in the slot defined by the U-element, the inner walls of the slot cut away the outer insulating layer (hence the term "insulation displacement"), and make contact with the central metal wire. An early version of such an insulation displacement connector (IDC) is shown in U.S. Pat. No. 3,202,957 issued to E. Leach, which has an M-shaped element, i.e., there are two parallel slots in the element for receiving the two wires to be interconnected.

The prior art is replete with variations in the structure of the bodies and contact elements used in insulation displacement connectors. Some of these are shown in the following U.S. Pat Nos.:

| U.S. Pat. No. | Inventor(s) |
|---|---|
| 3,189,863 | E. Leach |
| 3,258,733 | R. Elm |
| 3,388,370 | R. Elm |
| 3,500,292 | Enright et al. |
| 3,573,713 | Enright et al. |
| 3,576,518 | Bazille et al. |
| 3,605,072 | A. Driscoll |
| 3,609,644 | W. Seim |
| 3,656,088 | W. Seim |
| 3,723,948 | Wyatt et al. |
| 3,793,611 | Johansson et al. |
| 3,793,612 | A. Driscoll |
| 3,845,236 | G. Anderson |
| 3,858,157 | J. Bazille |
| 3,869,190 | J. Bazille |
| 3,912,356 | R. Johansson |
| 3,949,467 | Mayala et al. |
| 4,124,265 | F. Turk |
| 4,326,767 | Silbernagel et al. |
| 4,444,448 | Silbernagel et al. |
| 4,444,449 | Aysta et al. |
| 4,496,206 | Markwardt et al. |
| Des. 191,399 | E. Leach |

Due to the fact that the contact element displaces the insulation only where the element itself contacts the metal wire, very little of the metal wire is exposed. While this is adequate for some applications, it has been found that the contact element/wire interface often corrodes due to permeation of moisture into the IDC, resulting in a failure of the connector. This problem may be overcome by filling the connector with a sealant, such as silicone grease, prior to making the connection, as suggested in U.S. Pat. No. 3,804,971 issued to J. Bazille. Of course, filling the connector with grease adds an extra step in use of the device, and requires the user to carry a supply of the grease. Even if the grease were placed in the connector at the factory, the Bazille device suffers an additional disadvantage in that there is no guarantee that the grease will be guided to a specific location, e.g., about the connection interface, since there is no defined path for the grease to follow. In other words, an excess amount of grease must be placed in the cavity of the base in order to insure that all voids within the connector are filled. This may result in the overflow of excess grease, which is undesirable.

It would be preferable to initially provide a sealing material within the connector, avoiding the separate step of filling the connector with an insulating grease. This is the approach taken in U.S. Pat. No. 3,410,950 issued to W. Freudenberq. The connector shown in that patent is an open ferrule having sidewalls which are bent and depressed over the conductors. As the conductors are seated in the contact elements, a film is ruptured, allowing sealant to flow around the connection.

The primary disadvantage of this article is that it requires the use of a special (i.e., expensive) crimping tool. Moreover, the construction of the article is complicated by the vacuum-forming and heating process used to apply the film to the article, which also contributes to extra expense of the finished item. Finally, the flow of sealing material depicted in Freudenberg is idealized, and the material often does not completely surround the connection (see col. 5, lines 33–40). As can be seen in FIG. 4 of that patent, it is nearly impossible for sealing material to flow above the wire (it is restricted by the film barrier), leaving the connection vulnerable to corrosion from moisture permeation. It would, therefore, be desirable and advantageous to devise an insulation displacement connector having a conformable sealing material which does not require the use of any special tools, which has a simplified construction, and which has improved sealing ability.

Accordingly, the primary object of the present invention is to provide an insulation displacement connector for interconnecting electrical wiring.

Another object of the invention is to provide such an insulation displacement connector having an internal sealant.

Still another object of the invention is to provide an insulation displacement connector in which the sealant flows about the conductor or encapsulates the junction between the wire and contact element to completely protect the connection from environmental influences.

Yet another object of the invention is to provide a sealed insulation displacement connector which may be used without the assistance of any special tools.

SUMMARY OF THE INVENTION

The foregoing objects are achieved in an insulation displacement connector comprising a housing having a plurality of channels therein for receiving the conductors to be connected, and further having reservoirs or voids therein adjacent to the channels, the voids being filled with a conformable sealing material. The housing also contains a contact element having a plurality of slots for contacting the conductors. As the contact element is placed about the conductors, a piston or post integral with the housing enters the voids, causing the sealing material to flow into the channels and conform around the conductors. For connecting wire pairs, the housing may take the form of a cap and base which snap together; a tap connector with a hinged cover is also disclosed.

BRIEF DESCRIPTION OF THE DRAWINGS

The novel features of the invention are set forth in the appended claims. The invention itself, however, will best be understood by reference to the accompanying drawings, wherein:

DESCRIPTION OF THE PREFERRED EMBODIMENT

Figure 1:
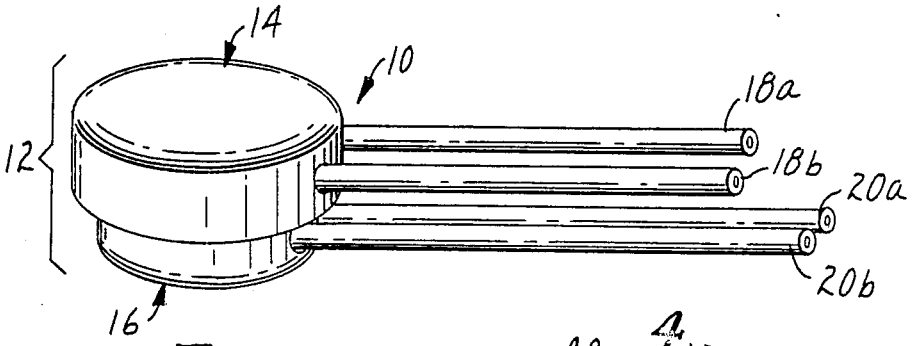
FIG. 1 is a perspective view of the wire pair connector embodiment, the present invention.

With reference now to the figures, and in particular with reference to FIG. 1, there is depicted the wire pair connector embodiment 10 of the sealed insulation displacement connector of the present invention. Wire pair connector 10 includes a housing 12 comprising cap portion 14 and base portion 16. A first pair of wires 18*a* and 18*b* enter cap 14, while a second pair of wires 20*a* and 20*b* enter base 16. Each of the wires consists of a central metal core (typically copper) surrounded by an insulative layer (typically polypropylene or polyethylene).

Figure 2:
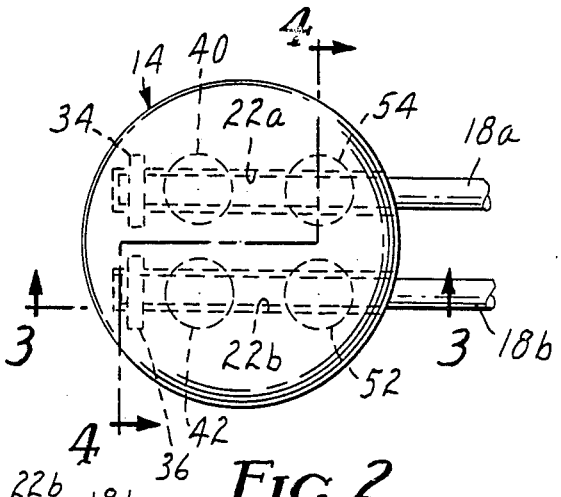
FIG. 2 is a top plan view of the wire pair connector showing the wire channels, voids, and contact elements within the housing in dashed lines.
Figure 3:
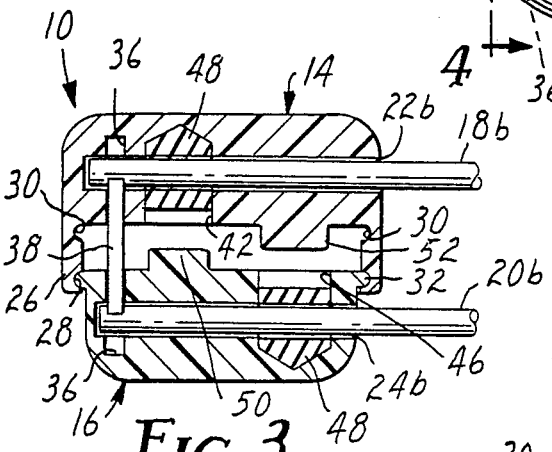
FIG. 3 is a cross-section of the wire pair connector taken along line 3—3 of FIG. 2.
Figure 4:
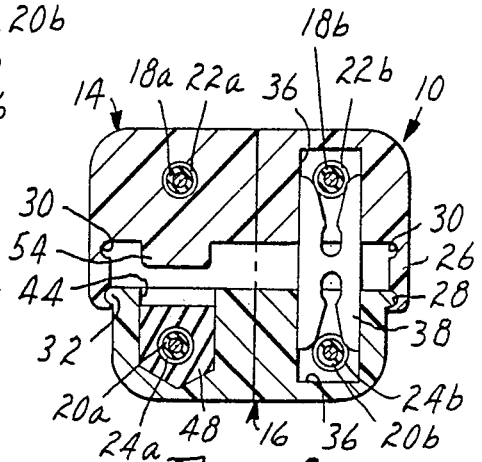
FIG. 4 is a cross-section of the wire pair connector taken along line 4—4 of FIG. 2.

Referring now to FIGS. 2, 3 and 4, it can be seen that the wires 18*a* and 18*b* enter channels 22*a* and 22*b*, respectively, in cap 14, while wires 20*a* and 22*b* enter channels 24*a* and 24*b*, respectively, of base 16. All of these channels are generally parallel, channel 22*a* being directly over channel 24*a*, and channel 22*b* being directly over channel 24*b*. The channels do not run completely through cap 14 or base 16, but rather terminate within housing 12 to provide only one access port for each channel.

In the preferred embodiment, cap 14 and base 16 are both generally cylindrical (although they need not be), and are constructed of any durable material such as polypropylene. Cap 14 and base 16 may be injection molded. The size of housing 12 depends on the gauge of the wires to be connected, which may be in the range of 10 to 30 AWG. For example, for 20 gauge wire, it is anticipated that cap 14 would have an outer diameter of about 10 millimeters, base 16 Would have an outer diameter of about 8 mm, and the combination would have a height of about 10 mm. These values are not, however, intended to be limiting.

Cap 14 includes an integral cuff portion 26 having an inner diameter approximately equal to the outer diameter of base 16 Cuff 26 has two inner annular grooves 28 and 30 designed to fit with an annular flange 32 on base 16. Cap 14 and base 16 also have complementary slots 34 and 36 for receiving H-shaped contact elements. While there are two such elements, only one element 38 is visible in the drawings, positioned in slot 36. The contact elements must be electrically conductive, and are preferably constructed of a copper alloy, such as cartridge brass. Slot 34 extends from channel 22*a* to channel 24*a*, while slot 36 extends from channel 22*b* to channel 24*b*.

The primary novelty of the present invention lies in the provision of reservoirs or voids adjacent to, and in fluid communication with, the channels in housing 12. There are four such voids (one for each channel), namely, voids 40, 42, 44 and 46. As best seen in FIG. 3, the voids actually surround the channels. Each of these voids is filled with a conformable sealing material 48. As a wire is inserted into one of the channels, it pierces the sealant, coating both the end of the wire and a portion of its outer surface. This immediately creates a seal at the end of the wire and a partial seal along the channel between the wire and cap 14 or base 16.

Sealing material 48 may take on a wide variety of characteristics depending upon the particular application made of wire pair connector 10. It is, however, preferably viscous, electrically insulative, and moisture resistant. For most applications, a mastic is sufficient, such as polyisobutylene, ethylene propylene rubber, butyl rubber or mixtures of these compositions. Other materials may be used, such as caulk, silicone grease, cured or uncured elastomers having processing oils or rubber modifiers, liquid elastomers, plasticizers, modified plastisols, or dielectric fillers (this list is not exhaustive).

When the wires 18*a*, 18*b*, 20*a* and 20*b* and first inserted into housing 12, annular flange 32 is abutting groove 28, providing a clearance of about 2 millimeters between the top of base 16 and the bottom of cap 14. Each of the voids opens toward this clearance space. Opposite these four openings, there are four plungers or pistons, three of which are visible in the figures, namely, pistons 50, 52 and 54. In other words, piston 50 underlies void 42, piston 52 overlies void 46, piston 54 overlies void 44, and the fourth piston (not shown) underlies void 40.

Figure 5:
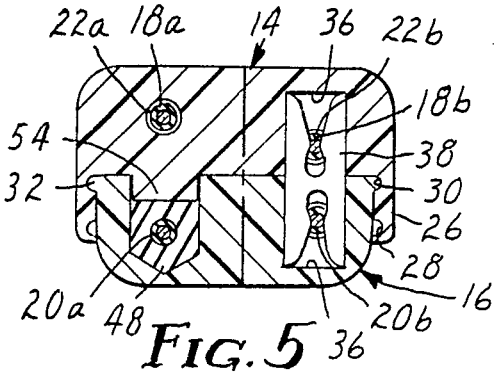
FIG. 5 is a cross-section of the wire pair connector similar to FIG. 4, but the cap and base have been snapped together, resulting in flow of the sealing material, and electrical connection between the contact element and the connectors.

Housing 12 is illustrated in an "open" position in FIGS. 3 and 4. Prior to installation of the wires, contact element 38 is clear of channels 22*b* and 24*b* (as best seen in FIG. 4), and the second contact element (not shown) is clear of channels 22*a* and 24*a*. This allows the wires to be fully inserted into the channels. After insertion of all four wires, Cap 14 and base 16 are squeezed together, as shown in FIG. 5, which corresponds to the "closed" position of housing 12. As cap 14 and base 16 move toward one another, H-element 38 captures wires 18*b* and 20*b*, stripping a portion of the insulating layer away, thereby making electrical contact between said wires. The second H-element (not shown) similarly makes contact between wires 18*a* and 20*a*.

Simultaneously, each of the pistons enters its corresponding void, forcing sealing material 48 down the channels, providing a reliable seal between the wire and cap 14 or base 16. Since the voids are located intermediate the H-elements and the entries to each of the channels, this results in an environmental seal which precludes any entry of moisture or other contaminants through the channels which might adversely affect the connection at the H-elements. If a mastic sealant is used, the seal thus formed may also provide strain relief, and tends to hold cap 14 and base 16 together. The final step in closing housing 12 is the engagement of annular flange 32 into groove 30 in an interference fit, which provides a tight seal between cap 14 and bas®16 (as well as holding them together). These five seals (four at the voids, and one between the cap and base) isolate the contact elements, the wire ends, and the connection between the contact element and the wires from air, moisture and other harsh environmental influences external to the connector.

It will be appreciated that the concept of a plunger driven sealant may be applied to more than one embodiment of an insulation displacement connector. To illustrate this point, a second embodiment is shown in FIGS. 6 through 9, which illustrate the tap connector embodiment 60 of the present invention. The basic construction of tap connector 60 is similar to that disclosed in U.S. Pat. No. 3,793,611 issued to Johansson et al. on Feb. 19, 1974. Tap connector 60 includes a housing 62, a cover 64, and a retaining wall 66 connected to housing 62 by a living hinge 68 and connected to cover 64 by another living hinge 70. The size of tap connector 60 will again Vary according to the gauge of the wires being connected; approximate dimensions for 20 gauge wire are 15 mm × 15 mm × 8 mm.

Housing 62 has two channels 72 and 74 therein for receiving run wire 76 and tap wire 78, respectively. There is only one entry to channel 74 (i.e., wire 78 terminates within housing 62), but channel 72 is open along one side to allow lateral placement of the run wire 76. Housing 62 includes a collar portion 80 which provides strain relief. Another collar (not shown) may be provided on the other side of housing 62 for run wire 76. A slot 82 is also provided in housing 62 for receiving an M-shaped contact element 84.

As with wire pair connector 10, the primary novelty in tap connector 60 lies in the proVision of four voids 86 in housing 62 which are in fluid communication with channels 72 and 74. Voids 86 are exposed along the upper surface 92 of housing 62, and are filled with the same sealing material 48. There are four corresponding plungers or posts 88 on the inner surface 90 of cover 64. In the preferred embodiment, one of the voids **86*a* extends fully to slot 82, and the corresponding post 99*a* is larger than the other posts 88. This allows simplified construction of housing 62** using injection molding techniques.

Figure 6:
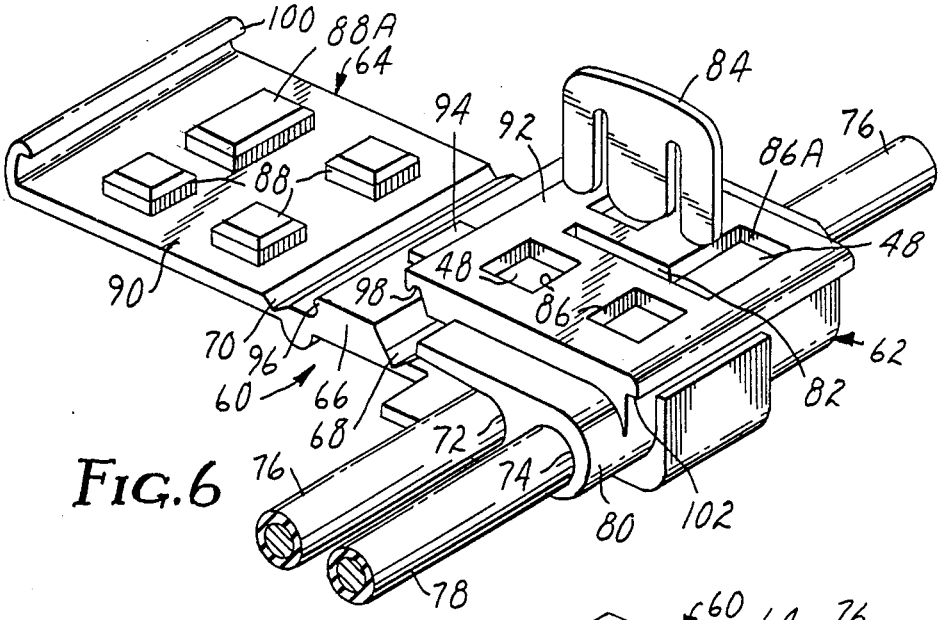
FIG. 6 is a perspective view of the tap connector embodiment of the present invention shown in an open state.
Figure 7:
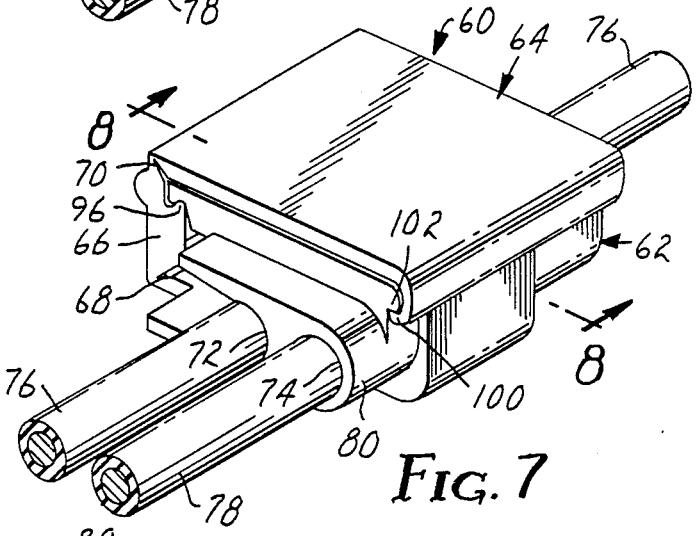
FIG. 7 is a perspective view of the tap connector similar to FIG. 6, but the hinged cover has been secured around the top of the connector.
Figure 8:
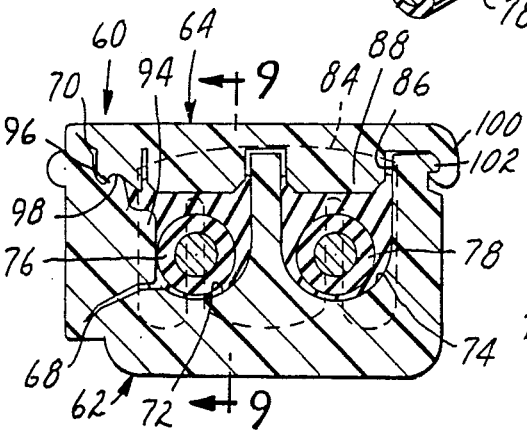
FIG. 8 is a cross-section of the tap connector taken along line 8—8 of FIG. 7.
Figure 9:
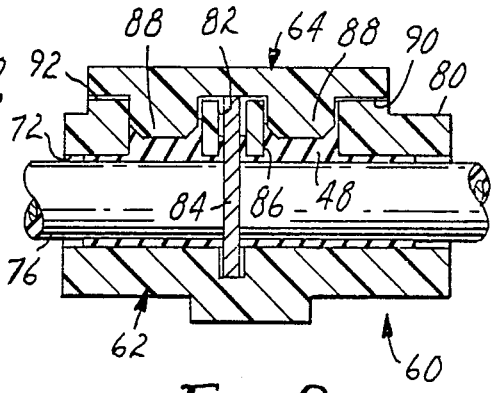
FIG. 9 is a cross-section of the tap connector taken along line 9—9 of FIG. 8.

Tap connector 60 is shown in the open state in FIG. 6, while FIGS. 7 through 9 depict the closed state thereof. M-element 84 is urged into slot 82 and strips away a portion of the insulating layer around wires 76 and 78, providing an electrical connection therebetween. As cover 64 is folded over upper surface 92 of housing 62, posts 88 enter voids 86, packing sealing material around the wires on either side of M-element element 84. The connection interface between M-element 84 and the wires is thereby completely sealed against environmental influences. Retaining wall 66, which may include a bump or boss 94 for positioning run wire 76 in channel 72, is held in place by an integral flange portion 96 which snaps into a notch 98 in housing 62. Cover 64 is similarly attached to housing 62 by means of an integral clip portion 100 which fits over the lateral edge 102 of housing 62 As those skilled in the art will appreciate, the use of the terms "post" and "piston" should not be construed as limiting. Rather, the invention contemplates the use of any means to force, squeeze or pack sealing material 48 from the voids into the channels and around the wires.

Although the invention has been described with reference to specific embodiments, this description is not meant to be construed in a limiting sense. Various modifications of the disclosed embodiment, as well as alternative embodiments of the invention, will become apparent to persons skilled in the art upon reference to the description of the invention. For example, the design of wire pair connector 10 might easily be modified for interconnection of two wires only, or for connection of a three-wire group to another three-wire group. Also, the invention is not limited to use on insulated wires, but may be used on wires which have a portion of the insulating layer already stripped away. It is therefore contemplated that the appended claims will cover such modifications that fall within the true scope of the invention.

We claim:

1. A device for electrically connecting two or more wires, comprising:

a cap member having a first channel therein for receiving one of the wires, and having a first void therein in fluid communication with said first channel;

a base member having a second channel therein for receiving another one of the wires, and having a second void therein in fluid communication with said second channel, said base and cap members defining a clearance space, and each of said voids opening toward said clearance space;

sealing material in each of said voids;

contact means located within said cap member and said base member for providing an electrical connection between the wires;

a first piston extending from said cap member into said clearance space opposite said second void in said base member; and a second piston extending from said base member into said clearance space opposite said first void in said cap member.

2. The device of claim 1 wherein said contact means includes at least one electrically conductive contact element having a plurality of slots for receiving the wires.

3. The device of claim 1 wherein:

said cap member has a first slot therein generally perpendicular to said first channel in said cap member;

said base member has a second slot therein generally perpendicular to said second channel in said base member and aligned with said first slot of said cap member; and said contact means includes an H-shaped contact element extending between said first and second slots.

4. The device of claim 1 further comprising:

a cuff attached to said cap member, said base member engaged with said cuff; and means for sealing said cap to said base.

5. A sealed wire connector comprising:

a cap having first and second channels therein, and having first and second voids in fluid communication with said first and second channels, respectively;

a base having third and fourth channels therein, and having third and fourth voids in fluid communication with said third and fourth channels, respectively, said base and said cap defining a clearance space therebetween, and each of said voids opening toward said clearance space;

sealing material filling each of said voids;

contact means located within said cap and base for providing an electrical connection between wires which may be inserted in said channels;

first and second pistons extending from said cap into said clearance space, said first piston located opposite said third void in said base and said second piston located opposite said fourth void in said base; and third and fourth pistons extending from said base into said clearance space, said third piston located opposite said first void in said cap and said fourth piston located opposite said second void in said cap.

6. The connector of claim 5 wherein:

said cap further includes a cuff, said base being partially inserted into said cuff; and said cuff also includes means for providing a seal between said cap and said base.

7. The connector of claim 6 wherein:

said cap has first and second slots extending from said clearance space into said first and second channels, respectively;

said base has third and fourth slots extending from said clearance space into said third and fourth channels, respectively, said third and fourth slots further being aligned with said first and second slots of said cap, respectively; and said contact means comprises first and second H-shaped contact elements, said first H-element extending between said first and third slots, and said second H-element extending between said second and fourth slots.

8. A sealed insulation displacement connector for interconnecting two pairs of wires, comprising:

an electrically insulative, generally cylindrical cap having:

a cuff, defining a clearance space, said cuff having first and second inner annular grooves, first and second channels, first and second voids exposed to said clearance space and in fluid communication with said first and second channels, respectively, first and second pistons extending from said cap into said clearance space, and first and second slots extending from said clearance space into said first and second channels, respectively;

an electrically insulative, generally cylindrical base having:

an annular flange for engagement with said first or second inner annular groove of said cap, third and fourth channels generally parallel to said first and second channels of said cap, third and fourth voids in fluid communication with said third and fourth channels, respectively, said third and fourth voids further being aligned with said first and second pistons of said cap, respectively, third and fourth pistons extending from said base into said clearance space, and aligned with said first and second voids in said cap, respectively, third and fourth slots extending from said clearance space into said third and fourth channels, respectively, said third and fourth slots further being aligned with said first and second slots of said cap, respectively; sealing material in each of said voids; and first and second H-shaped contact elements, said first H-element positioned in said first and third slots, and said second H-element positioned in said second and fourth slots.

9. A sealed insulation displacement connector for connecting a tap wire to a run wire, comprising:

an electrically insulative housing having:

a first channel running completely through said housing and being exposed along its length, a second channel terminating within said housing, an upper surface, first and second voids proximate said first channel, exposed at said upper surface and in fluid communication with said first channel, third and fourth voids proximate said second channel, exposed at said upper surface and in fluid communication with said second channel, and a slot which is generally perpendicular to said first and second channels; sealing material in each of said voids;

an M-shaped contact element located in said slot;

a retaining wall hingedly attached to said housing proximate said first channel;

a cover hingedly attached to said retaining wall;

first, second, third and fourth posts each attached to said cover whereby, when said cover is placed against said upper surface of said housing, said first, second, third and fourth posts enter said first, second, third and fourth voids, respectively: and means for securing said cover over said upper surface of said housing.

10. A device for electrically connecting two or more wires, comprising:

housing means having at least two voids therein and at least two channels therein for receiving the wires, each said channel being in fluid communication with one of said voids, and said housing means further having an upper surface, said voids being exposed at said upper surface;

means for covering said upper surface of said housing means;

sealing material in each of said voids;

contact means located within said housing means for providing an electrical connection between the wires; and a plurality of posts, one for each of said voids, attached to said cover means whereby, as said cover means is placed over said upper surface of said housing means, said posts enter said voids, packing said sealing material around the wires.

11. The device of claim 10 wherein:

said housing means includes a slot which is generally perpendicular to said channels; and said contact means comprises an M-shaped contact element located within said slot.

12. The device of claim 10 wherein one of said channels is exposed along its length, allowing lateral insertion of one of the wires, and further comprising means for retaining the laterally inserted wires in said exposed channel.

* * * * *

UNITED STATES PATENT AND TRADEMARK OFFICE

CERTIFICATE OF CORRECTION

PATENT NO. : 4,954,098

DATED : September 4, 1990

INVENTOR(S) : Elmont E. Hollingsworth and Gary W. Schlaeger

It is certified that error appears in the above-identified patent and that said Letters Patent is hereby corrected as shown below:

Column 3, Line 22, "connectors." should read --conductors.--

Column 3, Line 49, "22b" should read --20b--

Column 4, Line 3, "base 16" should read --base 16.--

Column 4, Line 38, second "and" should read --are--

Column 5, Line 8, "bas" should read --base--

Column 5, Line 26 "Vary" should read --vary--

Column 5, Line 41, "proVision" should read --provision--

Column 5, Line 48, "99a" should read --88a--

Column 5, Line 59, "M-element element 84." should read --M-element 84.--

Column 5, Line 67, "housing 62" should read --housing 62.--

Signed and Sealed this

Seventeenth Day of December, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,954,098

DATED : September 4,1990

INVENTOR(S) : Elmont E. Hollingsworth, et al

It is certified that error appears in the above-identified patent and that said Letters Patent is hereby corrected as shown below:

Column 8, line 66, "wires" should read --wire--

Signed and Sealed this

Seventeenth Day of December, 1991

*Attest:*

HARRY F. MANBECK, JR.

*Attesting Officer*

*Commissioner of Patents and Trademarks*